United States Patent [19]

Finnegan et al.

[11] 3,959,610

[45] May 25, 1976

[54] HERMETICALLY SEALED KEYBOARD TYPE ASSEMBLY WITH ELASTOMERIC ELECTRICAL CONNECTING LINK BETWEEN SWITCH AND COMPONENT MODULES

[75] Inventors: John P. Finnegan, Wheaton, Ill.; Bernard Gasparaitis, Fort Lauderdale, Fla.

[73] Assignee: Motorola, Inc., Chicago, Ill.

[22] Filed: Dec. 13, 1974

[21] Appl. No.: 532,541

[52] U.S. Cl. ..... 200/5 A; 200/159 B; 200/264; 200/340

[51] Int. Cl.[2] ..... H01H 13/70; H01H 1/58

[58] Field of Search ..... 200/1 R, 5 R, 5 A, 86 R, 200/159 B, 243, 262–265, 307, 340, 302

[56] References Cited

UNITED STATES PATENTS

| | | | |
|---|---|---|---|
| 3,676,607 | 7/1972 | Nash et al. | 200/5 A X |
| 3,676,615 | 7/1972 | Wiedmer | 200/159 B X |
| 3,699,294 | 10/1972 | Sudduth | 200/5 A X |
| 3,758,733 | 9/1973 | DuRocher et al. | 200/264 X |
| 3,843,851 | 10/1974 | Harada et al. | 200/5 A X |
| 3,860,771 | 1/1975 | Lynn et al. | 200/340 X |
| 3,862,382 | 1/1975 | Glaister et al. | 200/5 R X |
| 3,879,586 | 4/1975 | DuRocher et al. | 200/159 B X |

*Primary Examiner*—James R. Scott
*Attorney, Agent, or Firm*—James W. Gillman; Eugene A. Parsons

[57] ABSTRACT

A housing having key portions of a resilient pad extending therethrough with a metal impregnated elastomer pad overlying the rear surface thereof, a sheet of insulating material having openings therethrough corresponding with the key portions and a plurality of contact areas on a printed circuit board overlying the insulating sheet and having a plurality of contacts on the rear surface thereof, a connecting link formed of a second sheet of insulating material having a plurality of areas of metal impregnated elastomeric material extending therethrough and corresponding in position with the contacts, a second PC board having a plurality of contacts in contact with the elastomeric areas of the connecting link and a frame compressing all of the components together to provide an electrical contact to the elastomeric material in the connecting link and complete a circuit between various contacts on the two printed circuit boards and provide a weather-tight multi-push button switch.

7 Claims, 6 Drawing Figures

HERMETICALLY SEALED KEYBOARD TYPE ASSEMBLY WITH ELASTOMERIC ELECTRICAL CONNECTING LINK BETWEEN SWITCH AND COMPONENT MODULES

BACKGROUND OF THE INVENTION

1. Field of the Invention

In the electronic field, and especially in the radio telephone field, multi-push button switches are extremely useful. The various buttons of such a switch are generally designated with numerical and/or alphabetic symbols and connected in circuitry so as to initiate a variety of tones or other circuits upon the depressing thereof. These multi-button switches are often used in portable radios and the like where severe weather conditions may prevail and where size is a dominating requirement.

2. Description of the Prior Art

A great many prior art, multi-push button switches have been devised wherein metal impregnated elastomeric material is utilized to complete a contact when a button is depressed. In particular, U.S. Pat. No. 3,699,294 entitled "Keyboard Digital Coding, Switch for Digital Logic, and Low Power Detector Switches" describes a switch utilizing a printed circuit board with contact areas thereon through which a circuit is completed when a portion of a sheet of metal impregnated elastomeric material is pressed thereagainst by depressing a push button. However, in this device as in all other similar devices, a plurality of electrical terminals extend outwardly from the printed circuit board and require laborious and time-consuming hard wiring thereto to connect the switch to the circuitry it is desired to operate. This hard wiring is generally very costly and requires considerable additional space.

SUMMARY OF THE INVENTION

The present invention pertains to an electrical switch assembly including a printed circuit board with electrical contact areas thereon and a resilient pad having integral button portions protruding from one side thereof and corresponding in size and relative position with openings in the wall of a housing, with a sheet of electrically insulating material having openings therethrough corresponding in relative position with the contact areas on the printed circuit board and a metal impregnated elastomeric sheet sandwiched between the printed circuit board and the resilient pad, which electrical switch assembly further includes a connecting link formed of a sheet of electrical insulating material having areas of conductive material impregnated elastomeric material extending between the sides thereof and positioned in juxtaposition to terminals on the rear of the printed circuit board and terminals on the rear of a second printed circuit board having electronic components mounted on the front thereof. The entire assembly is compressed, sandwichlike, so that the areas of elastomeric material in the connecting link complete conducting paths between predetermined ones of the terminals on the rear surfaces of the two printed circuit boards. Thus, the connecting link completes connections between the multi-push button switch and the components on the second printed circuit board to eliminate the need for hard wiring and to greatly reduce the cost and space required for such hard wiring.

It is an object of the present invention to provide a new and improved electrical, multi-push button switch assembly.

It is a further object of the present invention to provide an electrical connecting link which greatly reduces the space required for connections between printed circuit boards and the like.

These and other objects of this invention will become apparent to those skilled in the art upon consideration of the accompanying specification, claims and drawings.

BRIEF DESCRIPTION OF THE DRAWINGS

Referring to the drawings wherein like characters indicate like parts throughout the figures.

DESCRIPTION OF THE PREFERRED EMBODIMENT

Figure 1:
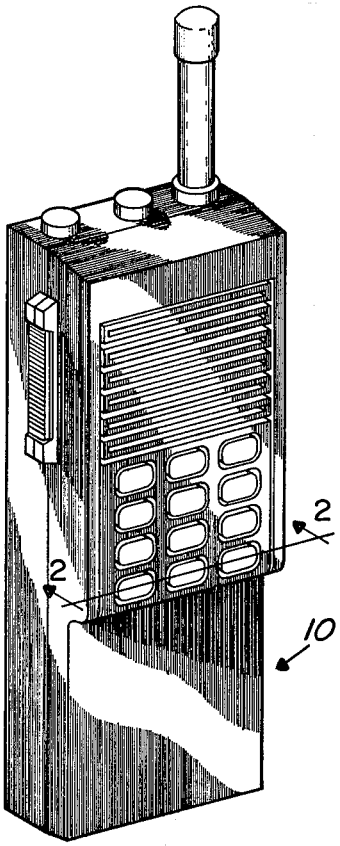
FIG. 1 is a view in top plan of an electrical, multi-push button switch assembly embodying the present invention.
Figure 2:
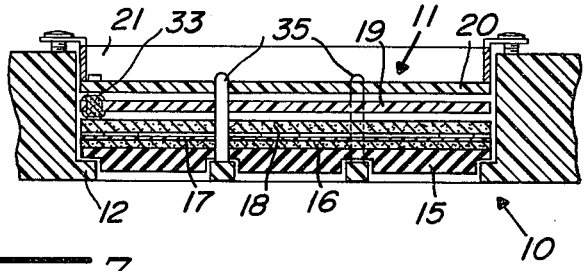
FIG. 2 is a sectional view as seen from the line 2—2 in FIG. 1.

In the FIGS. 1 to 4, the numeral 10 generally designates a housing, which may be a housing constructed only for the switch assembly or which may be a portion of a larger housing for a radio or the like. The housing 10 defines a cavity 11 with a front wall 12. The front wall 12 has a plurality of regularly spaced openings 13 therethrough designed to receive a plurality of outwardly projecting push buttons. The housing is preferably formed of an insulating material and may be for example a molded plastic or the like. It is preferable to form the housing of insulating material to reduce the possibility of unwanted electrical paths between components therein and to reduce the cost of the housing.

A key pad 15, contact pad 16, insulating sheet 17, first printed circuit board 18, connecting link 19, and second printed circuit board 20 are sandwiched into the cavity 11 of the housing 10 in overlying relationship and held in place by a mounting frame 21, as will be explained in more detail presently. Each of the components 15 to 20 is a generally flat, rectangularly shaped piece designed to fit parallel with the front wall 12 of the housing 10 in this embodiment, but it should be understood that the various components and the front wall 12 might be constructed in substantially any desired configuration.

The key pad 15, in the present embodiment, is molded from silicone rubber and has a plurality of regularly spaced outwardly projecting keys 25 integrally formed therewith. The keys 25 are on the side of the key pad 15 adjacent the front wall 12 and correspond with the openings 13 in position and size so that a key 25 extends partially through each of the openings 13 when the key pad 15 is placed in overlying relationship to the front wall 12. The keys 25 do not extend completely through the openings 13 to prevent inadvertent contact therewith but extend sufficiently into the openings 13 so as to be readily accessible. The key pad 15 is sufficiently resilient so that pressure applied to any of the keys 25 through an opening 13 will be transferred through the key pad 15 to the area immediately therebehind in the contact pad 16.

The contact pad 16 is formed from a metal impregnated elastomeric material which is commercially available and can be cut to size and laminated to the rear surface of the key pad 15. The commercially available elastomers include electrically conductive silicone or fluorosilicone elastomers, which elastomers may be impregnated with particles of silver, nickel, carbon or other particles of conductive material. When the material is in its normal uncompressed state it is non-conductive, but when the material is compressed it becomes conductive. In the present embodiment the contact pad 16 is approximately 0.01 to 0.02 inches (0.254 to 0.508 millimeters) thick, although it should be understood that any thickness which will provide the desired electrical path and carry the required current may be utilized.

In this embodiment, the insulating sheet 17 is formed of mylar material having a thickness of approximately 0.005 to 0.007 inches (0.127 to 0.178 millimeter). It should be understood, however, that any material which provides the required insulation might be utilized. The sheet 17 has a plurality of openings 26 formed therethrough, which correspond in position and approximate size with the keys 25 on key pad 15. The thickness of the sheet 17 must be sufficient to prevent the contact pad 16 from touching the printed circuit board 18 with no pressure applied to the keys 25, but the sheet 17 must be sufficiently thin for the contact pad 16 to make good contact with the printed circuit board 18 when pressure is applied to one of the keys 25.

The printed circuit board 18 has a plurality of contact areas 27 formed on the side thereof adjacent the insulating sheet 17. Each of the contact areas 27 generally corresponds in position and size with the openings 26 in the insulating sheet 17. The contact areas 27 are each formed of a plurality of interdigitated fingers of conducting material with one group of the fingers forming a first contact or side of the switch and the other group of fingers forming the other side or contact of the switch. Each side or contact of each of the contact areas 27 is connected by way of leads 28, printed on the opposite side of the printed circuit board 18, to one of a plurality of terminals or contact pads printed on the side of the board 18 adjacent the connecting link 19. While the terminals or contact pads 29 are positioned along one edge of the board 18 in the present embodiment, it should be understood that these terminals might be positioned at any position convenient to connection with a mating terminal 30 on the printed circuit board 20. Further, while 8 terminals 29 are utilized to couple 12, keys, in this embodiment, it should be understood that any convenient number of terminals desired might be utilized.

The connecting link 19 is a layer of insulating material positioned between the printed circuit boards 18 and 20 to prevent unwanted electrical contact therebetween. The printed circuit board 20 is designed to have components mounted on the side opposite the connecting link 19 and solder spikes and the like may be present on the side adjacent the connecting link 19. Therefore, the connecting link 19 is formed essentially of a nylon frame with large openings therethrough to receive solder spikes and the like present on the adjacent surface of the printed circuit board 20. The thickness of the connecting link 19 must be sufficient to prevent the solder spikes from contacting the rear surface of the printed circuit board 18. Further, the material from which the contact link 19 is formed must be sufficiently hard to prevent undue compression thereof and consequent unwanted electrical contact between the printed circuit boards 18 and 20. In addition to the large openings for receiving the solder spikes, the connecting link 19 has a plurality of smaller openings, corresponding in position with the terminals 29 on the adjacent surface of the printed circuit board 18, each of which has an elastomer contact stud press fit therein. The elastomer contact studs are formed of elastomeric material impregnated with conductive material to provide an electrically conductive path when the contact stud is compressed. Because the contact studs are press fit into the openings in the connecting link 19, the ends thereof have a tendency to mushroom slightly outwardly beyond the surfaces of the connecting link 19 to hold the contact studs firmly in place and to allow sufficient compression of the elastomeric material to provide a good electrical path therethrough when the connecting link 19 is sandwiched tightly between the printed circuit boards 18 and 20. It should of course be understood that the assembly might be constructed with the contact studs engaged in the connecting link 19 in a different fashion and either the contact studs or the terminals 29 and 30 on the printed circuit boards 18 and 20, respectively, might project out sufficiently to provide the necessary compression of the elastomeric material in the contact studs 33. Further, in the present embodiment each of the contact studs 33 provides an electrical path from a terminal 29 on the printed circuit board 18 to a terminal 30 on the printed circuit board 20 but it should be understood that the contact studs 33 might be formed to provide an electrical path between terminals on the same board or between a plurality of terminals on either of the boards.

The terminals 30 on the side of the printed circuit board 20 adjacent the connecting link 19 are connected to components, electrical circuits, and the like on the opposite side of the printed circuit board 20 in the normal manner. The mounting frame 21 is constructed to engage the edges of the printed circuit board 20 and compress the components 15 to 20 into a tightly sandwiched assembly within the cavity 11 of the housing 10. The assembly must be compressed sufficiently to compress the contact rods 33 in the connecting link 19 so as to provide a good electrical path between the terminals 29 and the terminals 30 on the printed circuit boards 18 and 20, respectively. The mounting frame 21 is constructed with the central portion thereof open to provide room for electrical components to be mounted on the outwardly directed surface of the printed circuit board 20. A pair of bosses 35 are formed integrally with the housing 10 and extend into the cavity 11 perpendicular to the front wall 12. Each of the components 15 to 20 has a pair of openings therethrough designed to receive the bosses 35 therethrough to align each of the components 15 to 20 within the cavity 11 and prevent relative movement therebetween. By compressing the key pad 15 tightly against the front wall 12 the entire switch is moisture-resistant and weather tight. Further, the contact pad 16 can be constructed slightly larger than the printed circuit board 18 to form an additional seal between the printed circuit board 18 and the housing 10.

Figure 5:
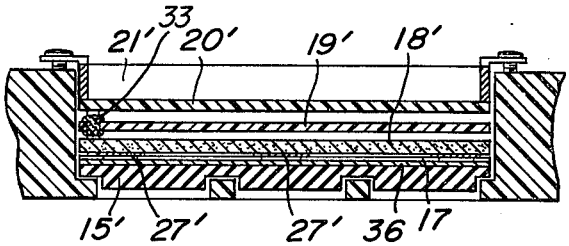
FIG. 5 is a sectional view similar to FIG. 2 of another embodiment.
Figure 4:
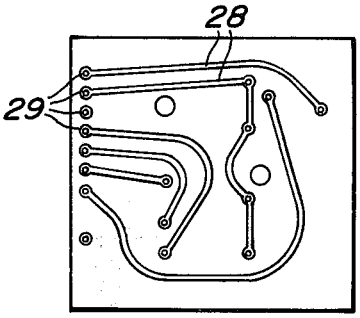
FIG. 4 is a view in top plan of the rear side of a printed circuit board in the assembly of FIG. 1.
Figure 6:
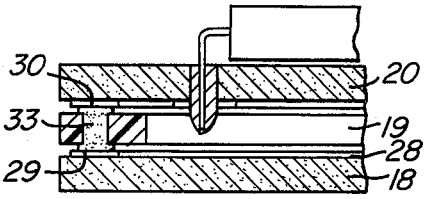
FIG. 6 is an enlarged sectional view of a portion of the connecting link in the electrical, multi-push button switch assembly.
Figure 3:
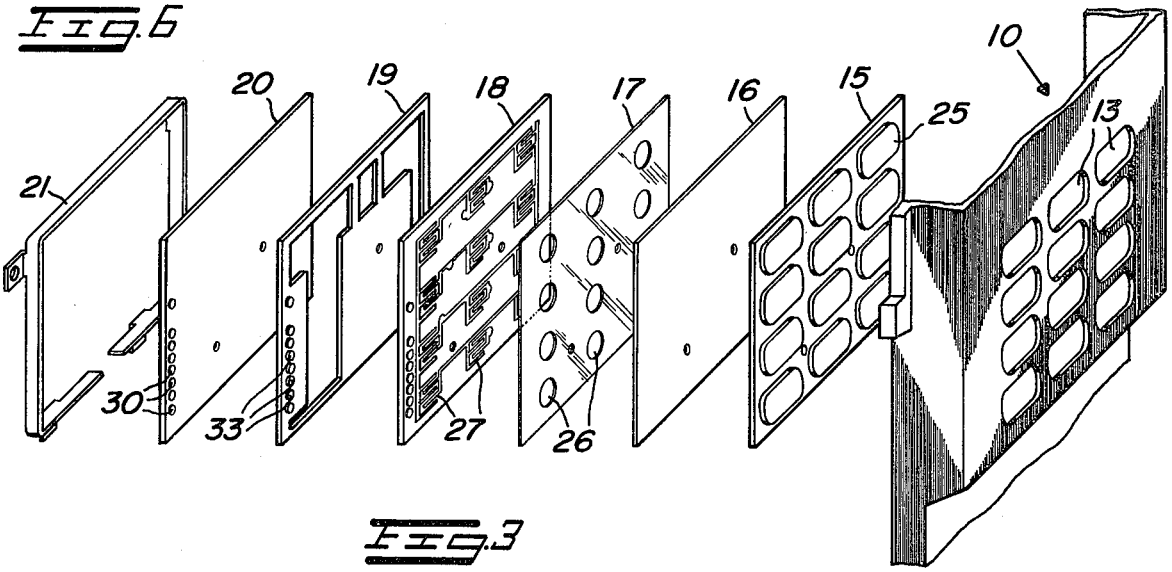
FIG. 3 is an exploded view in perspective of the various components of the switch illustrated in FIG. 1.

Another embodiment of the switch assembly is illustrated in FIG. 5. In this embodiment all components similar to components in the previous embodiment have similar numbers and all of the numbers have a prime added to indicate the different embodiment. The contact pad 16 is eliminated in this embodiment and the key pad 15' has a layer 36' of conducting material, such as silver, copper, etc., affixed to the rear surface thereof. The key pad 15' is sufficiently resilient to allow the layer of conducting material 36' to extend through the openings in the insulating sheet 17' and provide a short between the inter-digitated fingers of the contact areas 27' on the printed circuit board 18'.

Thus, an electrical connecting link and switch assembly is disclosed which is small and compact. Also, the assembly is extremely easy to assemble initially or to disassemble for maintenance purposes. While we have shown and described specific embodiments of this invention, further modifications and improvements will occur to those skilled in the art. We desire it to be understood, therefore, that this invention is not limited to the particular form shown and we intend in the appended claims to cover all modifications which do not depart from the spirit and scope of this invention.

We claim:

1. An electrical, multi-push button switch assembly comprising:

a. a housing defining a cavity with a wall between the cavity and a front surface, the wall having a plurality of openings therethrough;

b. a resilient pad having integral button portions corresponding in size and relative position with the openings in the wall of said housing protruding from one side thereof, said pad being positioned in the cavity of said housing in parallel, juxtaposition with said wall with the button portions protruding through the openings;

c. a sheet of electrically insulating material having openings therethrough corresponding in relative position with the button portions and positioned generally in overlying relationship to said resilient pad opposite the wall of said housing;

d. conductive means sandwiched between said resilient pad and said insulating sheet;

e. a first printed circuit board positioned in overlying relationship to said insulating sheet and having a plurality of contact areas on one side thereof corresponding in position with the openings in said insulating sheet, said contact areas being electrically connected to electrical terminals on the opposite side of said first printed circuit board and further being constructed to complete a circuit between a predetermined pair of the terminals upon depressing one of said button portions of said resilient pad to force said conductive means thereagainst;

f. a connecting link formed of a spacer of electrically insulating material having areas of elastomeric material extending between the sides thereof, said spacer being positioned in overlying relationship to said printed circuit board with one of said areas of elastomeric material being in juxtaposition to one each of the electrical terminals thereon, said elastomeric material having conductive particles distributed therethrough to form an electrically conductive path from one side of said connecting link to the other when the elastomeric material therein is compressed;

g. a second printed circuit board having components mounted on one side thereof and a plurality of terminals in electrical connection with the components on the opposite side thereof, said second printed circuit board being positioned in overlying relationship to said connecting link with the terminals thereon positioned in juxtaposition to predetermined ones of the elastomeric areas therein; and h. mounting means positioned in contact with said second printed circuit board and engaged with said housing for compressing the assembly together until electrical connections are made between the terminals on the first and the second printed circuit boards through the elastomeric areas in the connecting link.

2. An electrical switch assembly as claimed in claim 1 wherein the conductive means includes an elastomeric sheet having conductive particles distributed therethrough to form an electrically conductive path through any predetermined portion thereof when the predetermined portion is compressed.

3. An electrical switch assembly as claimed in claim 1 wherein the conductive means includes a layer of conductive material affixed to the rear surface of the resilient pad.

4. An electrical switch assembly as claimed in claim 1 wherein said housing includes a pair of positioning bosses affixed to the wall thereof and extending into the cavity, each of said resilient pad, said insulating sheet, said first printed circuit board, said connecting link and said second printed circuit board having a pair of alignment holes extending therethrough for receiving said bosses therethrough in the assembled position.

5. An electrical switch assembly as claimed in claim 1 wherein the resilient pad is molded silicone rubber.

6. An electrical switch assembly as claimed in claim 1 wherein the sheet of electrically insulating material is formed of mylar having a thickness in the range of approximately 0.005 to 0.007 inches (0.127 to 0.178 millimeters).

7. An electrical switch assembly as claimed in claim 1 wherein the areas of elastomeric material in the connecting link are rods of elastomeric material press fit into holes in the second sheet of insulating material.

* * * * *